US007505704B2

(12) United States Patent
Facci et al.

(10) Patent No.: US 7,505,704 B2
(45) Date of Patent: Mar. 17, 2009

(54) LUBRICATION-STRIPE SYSTEM FOR A XEROGRAPHIC PRINTER USING AN ELECTROSTATIC CLEANING BRUSH AND SPOTS BLADE

(75) Inventors: John S Facci, Webster, NY (US); Robert M Mara, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 429 days.

(21) Appl. No.: 11/456,746

(22) Filed: Jul. 11, 2006

(65) Prior Publication Data

US 2008/0013978 A1 Jan. 17, 2008

(51) Int. Cl.
*G03G 21/00* (2006.01)

(52) U.S. Cl. ..... 399/71; 399/346

(58) Field of Classification Search ..... 399/71, 399/346, 349, 353, 354
See application file for complete search history.

(56) References Cited

U.S. PATENT DOCUMENTS

| | | | | |
|---|---|---|---|---|
| 5,339,149 | A | 8/1994 | Lindblad et al. | |
| 5,463,455 | A | 10/1995 | Pozniakas et al. | |
| 6,925,282 | B2 | 8/2005 | Drawe et al. | |
| 7,362,996 | B2 * | 4/2008 | Facci et al. | 399/346 |

* cited by examiner

*Primary Examiner*—William J Royer
(74) *Attorney, Agent, or Firm*—R. Hutter

(57) ABSTRACT

A xerographic printer includes a cleaning system having an electrically biased brush and a spots blade downstream of the brush. At various times a "lubrication stripe" dense toner is placed on a photoreceptor to lubricate the spots blade. In order for the lubrication stripe to reach the spots blade, the bias on the brush is momentarily decreased while the lubrication stripe moves past the brush. Also, the specific color of the lubrication stripe can be selected for various situations.

15 Claims, 3 Drawing Sheets

LUBRICATION-STRIPE SYSTEM FOR A XEROGRAPHIC PRINTER USING AN ELECTROSTATIC CLEANING BRUSH AND SPOTS BLADE

TECHNICAL FIELD

The present disclosure relates to electrostatographic printing, and in particular the use of a "lubrication stripe" for aiding a cleaning system.

BACKGROUND

U.S. Pat. No. 5,463,455 describes an electrostatographic printer in which, at selected times, a lubrication stripe or "lube stripe" is placed on a rotating photoreceptor, using the same hardware as used to place images to be printed, such as imaging and development units. The lubrication stripe is a small strip of toner that contacts and thereby lubricates a cleaning blade.

The cleaning system in the '455 patent relies on an unbiased "disturber brush" and a cleaning blade that removes essentially all of the excess toner desired to be cleaned from a photoreceptor surface. However, high-speed and color printers often use an "electrostatic brush cleaner" in their cleaning systems. In an electrostatic brush cleaner, at least one rotating brush is strongly biased to a polarity suitable for electrostatically attracting the excess toner to be cleaned. Downstream of the brush is what is called a "spots blade," which differs from a straightforward cleaning blade in that it is largely optimized to remove toner spots that are not typically removed by the brush. U.S. Pat. No. 5,339,149 discloses a basic design of an electrostatic brush cleaner with a spots blade. U.S. Pat. No. 6,925,282 teaches the same basic design, but further discusses the technological problem with keeping a spots blade properly clean.

SUMMARY

According to one aspect, there is provided an electrostatographic printing apparatus, comprising a charge receptor, movable in a process direction, defining a main surface. A cleaning station cleans the main surface of the charge receptor, the cleaning station including at least one biased member and a blade engaging the main surface of the charge receptor downstream of the biased member, the biased member having an effective area associated therewith relative to motion of the charge receptor. Means are provided for placing a lubrication stripe of marking material on a portion of the main surface of the charge receptor at a selected time. A control system adjusts a bias on the biased member substantially during a time when a lubrication stripe is in the effective area of the biased member, to substantially prevent marking material in the lubrication stripe from being detached from the main surface of the charge receptor by the biased member.

DETAILED DESCRIPTION

Figure 1:
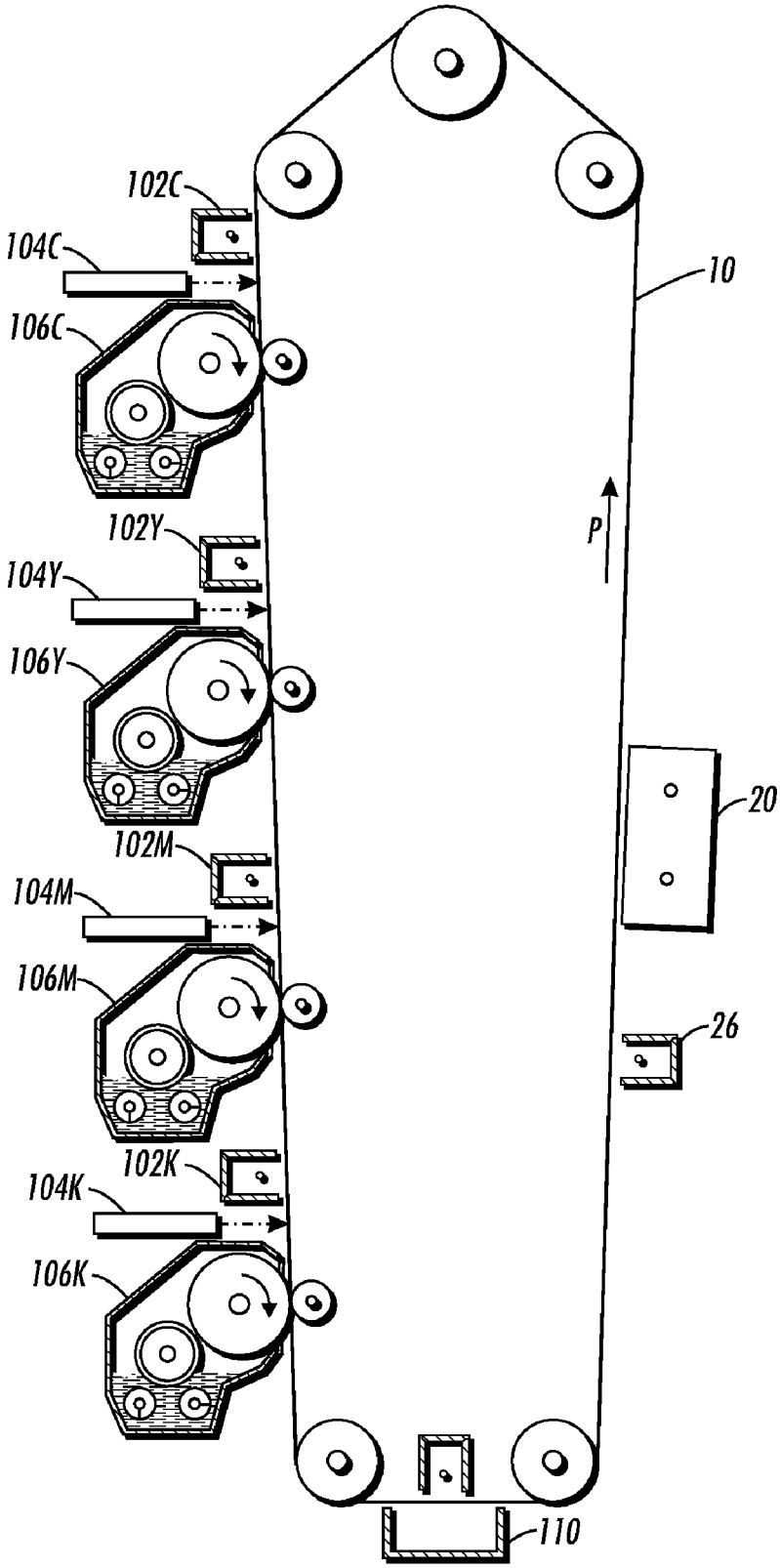
FIG. 1 PRIOR ART
FIG. 1 is a simplified elevational view of a color electrostatographic printer.

FIG. 1 is a simplified elevational view of a color electrostatographic or xerographic printer, in this case using "image-on-image" technology to build up color images on a single photoreceptor, in a manner generally known in the art. There is provided a charge receptor in the form of a photoreceptor 10, which rotates along a process direction indicated as P. The main surface of the photoreceptor 10 passes through a series of charging stations 102C, 102Y, 102M, 102K, imaging stations 104C, 104Y, 104M, 104K,(such as including raster output scanners or LED arrays) and development units 106C, 106Y, 106M, 106k, each development unit corresponding to a different primary color (cyan, yellow, magenta and black (K)).Each set of stations places a layer of marking material such as toner of one primary color on the main surface of photoreceptor 10, thus building up a full-color image to be printed. The built-up layers of marking material are then transferred to a print sheet at transfer station 110, as indicated. Any marking material remaining on the main surface of photoreceptor 10 following the transfer step is then removed at cleaning station 20.

Figure 2:
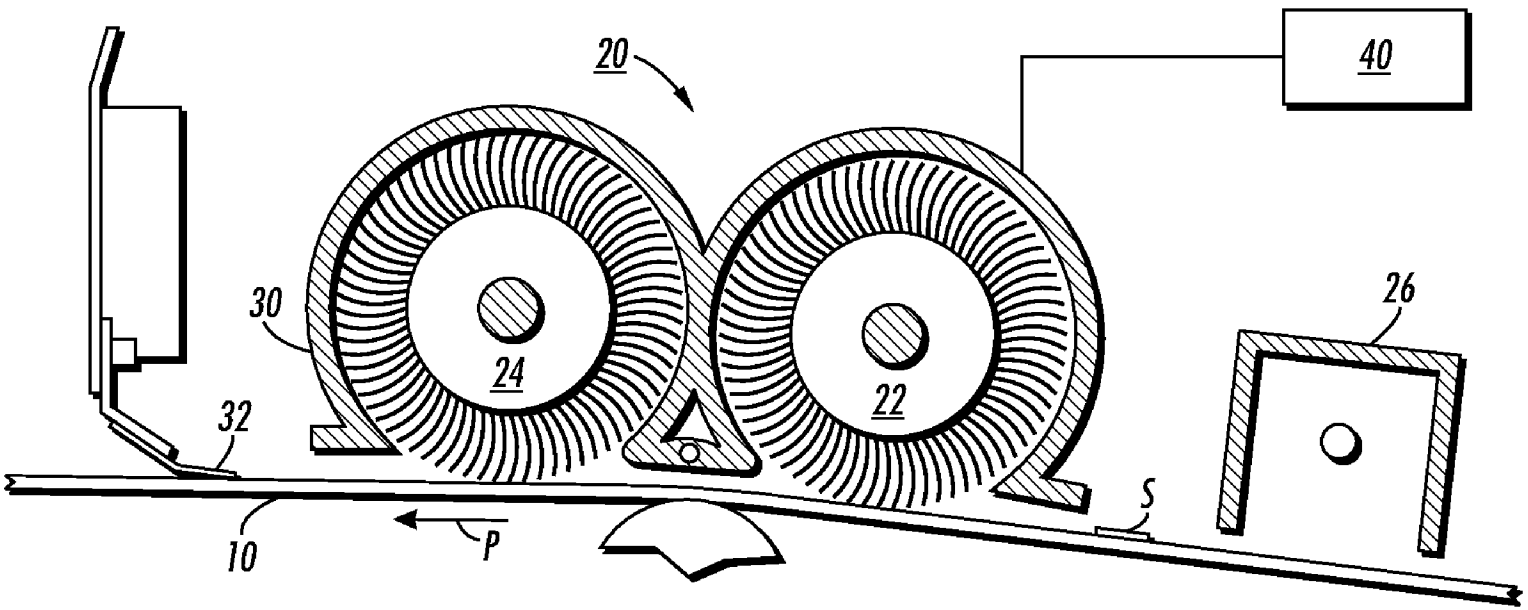
FIG. 2 PRIOR ART
FIG. 2 is an elevational view of a dual-electrostatic brush cleaning station.

FIG. 2 is an elevational view of a dual-electrostatic brush cleaning station, generally indicated as 20. In the embodiment, the station includes a first rotatable brush 22, followed in the process direction P by a second rotatable brush 24. Each brush 22, 24 is in contact with a portion of the main surface of photoreceptor 10 and rotates (by a motor, not shown) in a direction against process direction P of the photoreceptor 10. The combination of electrical bias and motion of each brush 22, 24 against the main surface of photoreceptor 10 causes toner particles to be removed from the main surface of photoreceptor 10 as the photoreceptor 10 moves through the cleaning station 20. The effective area of each brush 22, 24, which in this context means the area of contact of the brush 22, 24, against a portion of the main surface of photoreceptor 10, is typically about 20 mm along process direction P. The brushes 22, 24 are together enclosed in a vacuum manifold 30, which allows a vacuum device (not shown) to remove toner particles from the brushes 22, 24.

Further in the embodiment, the first rotatable brush 22 is biased (by a power supply, not shown) to a voltage and polarity generally suitable for electrostatically drawing toner particles off of the main surface of photoreceptor 10. In one practical application, a pre-clean charging device in the form of pre-clean corotron 26, upstream of the cleaning station 20, first provides a negative charge of −120 μA on the surface, and then the first brush 22 is biased to +290V, thereby attracting the negatively-charged residual toner off of the main surface of photoreceptor 10. In practice, the first brush 22 removes about 95% of the residual toner. The second brush 24 is negatively biased, to about −450V, and removes the remaining toner which is positively charged, or wrong sign toner.

Following the second brush 24 along the process direction P, there is provided what is generally called a "spots blade" 32. Even though almost all of the residual toner is leaned from the main surface of photoreceptor 10 by brushes 22, 24, there may remain some spots of debris that cannot easily be removed by the brushes. A spots blade, used with one or more biased brushes differs in configuration from a cleaning blade such as disclosed in U.S. Pat. No. 5,463,455. A cleaning blade may work with an unbiased "disturber brush," but would have most or all of the burden of removing toner from the photoreceptor. As such, a cleaning blade such as in the '455 patent typically has an orientation ("working angle" ) against the surface of the photoreceptor of 10°-16°, and is loaded against the photoreceptor at a range of 20-30 g/cm$^2$. In contrast, a spots blade such as 32 is designed specifically to remove spots which are not easily removed by the biased brushes 22, 24, and therefore has a load pressure on the main surface of the photoreceptor (charge receptor) 10 of less than 15g/cm$^2$(typically about 8g/cm$^2$) as well as a working angle of less than 12° (typically about 8°) against the photoreceptor 10.

In a practical operation of a printer such as shown FIG. 1, at preselected times a "lubrication stripe"is desired to be placed on the main surface of photoreceptor 10. The purpose of the lubrication stripe is to provide some lubrication to the spots blade 32; the toner itself has certain lubricative properties. One embodiment of a lubrication stripe is a stripe of toner, arranged perpendicular to the process direction P extending substantially the entire width of photoreceptor 10, and having a length along process direction P of 0.5-0.75 mm (although precisely controlling the dimensions of the stripe for various reasons is known). In one practical application, a lubrication stripe is placed on the photoreceptor 10 with every other rotation of photoreceptor 10, located just following the seam of the photoreceptor 10. The lubrication stripe is placed on photoreceptor 10 by any available means for placing marking material, such as a suitably-controlled charging station 102K, imaging station 104K, and development unit 106K such as shown in FIG. 1, on the photoreceptor 10, although lubrication stripes are not transferred to a print sheet at transfer station 110.

In order for a lubrication stripe, shown in FIG. 2 as S, to lubricate the spots blade 32, the lubrication stripe S must not be erased by either biased brush 22 or 24. To achieve this goal, the cleaning station 20 is controlled so that at least one biased brush, such as 22, is effectively disabled while the lubrication stripe S passes through the effective area of the brush 22.

Figure 3:
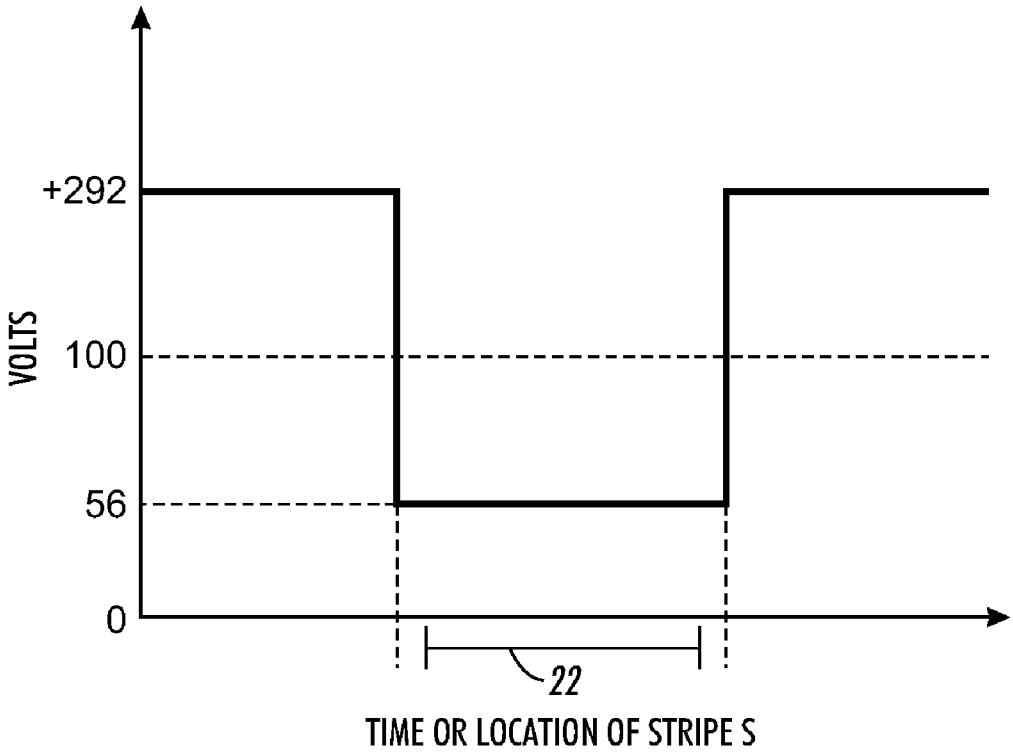
FIG. 3 is a graph illustrating the control of a bias in a cleaning station.

FIG. 3 is a diagram showing the control of a bias on brush 22 (by a control system, indicated generally as 40 in FIG. 2) in one practical embodiment. In a basic state, the brush 22 is biased to +290V for removing toner from the main surface of photoreceptor 10. While the lubrication stripe S passes through the effective area of brush 22, the bias on brush 22 is adjusted to go down to +56V, which is insufficient to detach the toner in lubrication stripe S from the main surface of photoreceptor 10. Once the lubrication stripe S leaves the effective area of brush 22, the bias on brush 22 is controlled to return to its basic state. The lubrication stripe S thus "survives" passage past the biased brush 22.

Further in this practical application, the brush 24, which is biased negatively, need not be adjusted in its bias, nor need there be any adjustment or change in the bias of pre-clean corotron 26. The fact that the pre-clean charging device such as pre-clean corotron 26 is not adjusted, i.e., retains a constant bias at all times, is useful from the standpoint of designing a power supply for the printer.

Another possible approach to controlling bias on the brushes 22, 24 is to momentarily cut or disable the power supply (not shown) for the whole cleaning station 20. Disabling the whole supply drops the output voltage to an indeterminate voltage or floating potential near OV or slightly negative (between −10V and 0V). Thus the voltage on both brushes 22, 24 is simultaneously adjusted to about 0V during passage of the lubrication stripe S. If separate power supplies are available for each brush 22, 24 one could have either or both of the brushes 22, 24 be either disabled or actively switched. At a minimum brush 22 (or brush 24 if it is configured to be the brush that does most of the cleaning) has to be switched off by either disabling or active switching.

More broadly, for most practical printer designs, brush 22 is biased to greater than +200V in its basic state, and biased to less than +100V when the lubrication stripe is in the effective area of brush 22. In one practical application, the adjusted bias should be just low enough to avoid detaching significant amounts of marking material from the main surface of photoreceptor 10; once again, this is useful from the standpoint of designing a power supply for the printer.

Although the described embodiment shows biased brushes 22, 24, other designs of cleaning systems may use other types of biased members as well, such as corotrons, rollers, or variations thereof.

In a full-color printer such as shown in FIG. 1, there is provided an opportunity to produce lubrication stripes using toner of different colors. In various situations, it may be desirable to provide lubrication stripes using yellow toner, because yellow toner is less likely to be conspicuous in situations where the lubrication stripe toner may accidentally spread into imageable areas and therefore be eventually transferred to print sheets. In other situations, however, particularly when a full-color printer is being used to print black-only prints, it would be preferable to output black lubrication stripes, so that the color development units do not have to be activated merely to output lubrication stripes. A control system of the printer can be programmed to output yellow or black (or otherwise non-yellow) lubrication stripes in preselected possible situations, such as just before or just after printing black-only jobs, or switching to color jobs, or printing jobs having a predetermined level of area coverage.

While the charge receptor in the above-described embodiment is a photoreceptor in an image-on-image printer, the above description can apply to other printing architectures and technologies as well. For example the charge receptor can be in the form of an intermediate belt accumulating marking material of various colors from one or more separate photoreceptors. The disclosure can also apply to situations in offset printing, or ink-jet printing with an intermediate member.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. An electrostatographic printing apparatus, comprising:

a charge receptor, movable in a process direction, defining a main surface;

a cleaning station for cleaning the main surface of the charge receptor, the cleaning station including at least one biased member and a blade engaging the main surface of the charge receptor downstream of the biased member, the biased member having an effective area associated therewith relative to motion of the charge receptor;

means for placing a lubrication stripe of marking material on a portion of the main surface of the charge receptor at a selected time;

a control system for adjusting a bias on the biased member substantially during a time when a lubrication stripe is in the effective area of the biased member, to substantially prevent marking material in the lubrication stripe from being detached from the main surface of the charge receptor by the biased member.

2. The apparatus of claim 1, the blade having a load pressure on the main surface of the charge receptor of less than 15 g/cm$^2$.

3. The apparatus of claim 1, the blade having a working angle of less than 12° relative to the main surface of the charge receptor.

4. The apparatus of claim 1, wherein the biased member is biased to greater than +200V in a basic state, and biased to less than +100V when the lubrication stripe is in the effective area of the biased member.

5. The apparatus of claim 1, the biased member including a brush in contact with a portion of the main surface of the charge receptor.

6. The apparatus of claim 5, the biased member including a rotatable brush, rotating against the process direction.

7. The apparatus of claim 1, the cleaning station including a first brush, the first brush being associated with the biased member, and a second brush.

8. The apparatus of claim 7, the first brush being biased to a first polarity in a basic state and the second brush being biased to an opposite polarity.

9. The apparatus of claim 8, wherein a bias on the second brush is not adjusted in any relationship to the adjusting of a bias on the first brush.

10. The apparatus of claim 8, wherein a bias on the second brush is adjusted substantially during the adjusting of a bias on the first brush.

11. The apparatus of claim 1, further comprising a pre-clean charging device disposed substantially immediately upstream of the cleaning station along the process direction.

12. The apparatus of claim 11, wherein a bias on the pre-clean charging device is not adjusted in any relationship to the adjusting of a bias on the biased member.

13. The apparatus of claim 1, the means for placing a lubrication stripe being selectably capable of placing a substantially non-yellow lubrication stripe or a substantially yellow lubrication stripe.

14. An electrostatographic printing apparatus, comprising:

a charge receptor, movable in a process direction, defining a main surface;

a cleaning station for cleaning the main surface of the charge receptor, the cleaning station including at least one biased member and a blade engaging the main surface of the charge receptor downstream of the biased member, the biased member including a brush in contact with an effective area of the main surface of the charge receptor, and the blade having a load pressure on the main surface of the charge receptor of less than 15 g/cm$^2$ and working angle of less than 12° relative to the main surface of the charge receptor;

a pre-clean charging device disposed substantially immediately upstream of the cleaning station along the process direction;

means for placing a lubrication stripe of marking material on a portion of the main surface of the charge receptor at a selected time;

a control system for adjusting a bias on the biased member substantially during a time when a lubrication stripe is in the effective area of the biased member, to substantially prevent marking material in the lubrication stripe from being detached from the main surface of the charge receptor by the biased member, and wherein a bias on the pre-clean charging device is not adjusted in any relationship to the adjusting of a bias on the biased member.

15. The apparatus of claim 14, the means for placing a lubrication stripe being selectably capable of placing a substantially non-yellow lubrication stripe or a substantially yellow lubrication stripe.

* * * * *